US008215630B2

(12) United States Patent
Fujii et al.

(10) Patent No.: US 8,215,630 B2
(45) Date of Patent: Jul. 10, 2012

(54) DEVICE PREVENTING PUNCHING AND STAPLING AT SAME LOCATION

(75) Inventors: Shuhji Fujii, Osaka (JP); Takashi Nakagawa, Osaka (JP); Nobuyuki Ueda, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 142 days.

(21) Appl. No.: 12/781,984

(22) Filed: May 18, 2010

(65) Prior Publication Data

US 2010/0308525 A1 Dec. 9, 2010

(30) Foreign Application Priority Data

Jun. 3, 2009 (JP) ..... 2009-133827

(51) Int. Cl.
*B65H 37/04* (2006.01)

(52) U.S. Cl. ..... 270/58.09; 270/58.08

(58) Field of Classification Search ..... 270/58.08, 270/58.09, 58.1, 58.11, 58.12, 58.13
See application file for complete search history.

(56) References Cited

U.S. PATENT DOCUMENTS 5,131,641 A * 7/1992 Hidaka ..... 270/58.08
5,746,162 A * 5/1998 Hosoi et al. ..... 270/37
6,029,026 A 2/2000 Natsume et al.
7,627,282 B2 * 12/2009 Oka et al. ..... 399/410

FOREIGN PATENT DOCUMENTS

| | | | |
|---|---|---|---|
| JP | 4-037592 A | | 2/1992 |
| JP | 10-247041 A | | 9/1998 |
| JP | 2001072320 A | * | 3/2001 |
| JP | 2003-101721 A | | 4/2003 |
| JP | 2003-110761 A | | 4/2003 |
| JP | 2004-051329 A | | 2/2004 |
| JP | 2006-154416 A | | 6/2006 |

* cited by examiner

*Primary Examiner* — Patrick MacKey
(74) *Attorney, Agent, or Firm* — Renner, Otto, Boisselle & Sklar, LLP

(57) ABSTRACT

An image forming apparatus, used with a post-processing apparatus performing a punching process and a stapling process allowing setting of position and number of staples, includes: a detecting device detecting a request in the post-processing unit based on request information input from a user; and a control device connected to receive an output of the detecting device and to control the post-processing apparatus, controlling the post-processing apparatus such that if the detecting device detects requests for the punching process and the stapling process on the same recording paper, manner of staple-binding of the recording paper is set to tentative binding.

5 Claims, 10 Drawing Sheets

DEVICE PREVENTING PUNCHING AND STAPLING AT SAME LOCATION

CROSS-REFERENCE TO RELATED APPLICATION

This nonprovisional application claims priority under 35 U.S.C. §119(a) on Patent Application No. 2009-133827 filed in Japan on Jun. 3, 2009, the entire contents of which are hereby incorporated by reference.

BACKGROUND OF THE INVENTION

1. Field of the Invention

The present invention relates to an image forming apparatus forming an image on a sheet of recording paper and, more specifically, to a technique of avoiding wasteful stapling in an image forming apparatus having a post-processing apparatus (finisher) performing hole punching process (forming punched holes) and staple binding process.

2. Description of the Background Art

Conventionally, a post-processing apparatus (finisher) capable of automatically performing staple binding (hereinafter also referred to as stapling or stapling process) and hole punching (hereinafter also referred to as punching or punching process) after image formation on recording paper by, for example, electro-photography is sometimes attached to an image forming apparatus. In the stapling process performed in the image forming apparatus, a bundle of paper is bound by using staples, and sets of recording paper bound by staples are successively stacked on a discharge tray.

When sets of recording paper are bound by staples, each set is stapled at a preset same position or positions. When all sets are bound and discharged to the discharge tray, the staples are at the same position. As a result, part of the recording paper stacked set by set rises high. Consequently, the number of stacks that can be placed on the tray becomes smaller and work efficiency lowers, or a staple on a set of recording paper that is being discharged may be caught by a staple of the last discharged set of recording paper, causing discharge failure or irregular stacking. In the following, a mechanism (apparatus) performing the stapling process will be referred to as a stapler.

Japanese Patent Laying-Open No. 4-37592 ('592 Reference) discloses a finisher as a solution to such a problem. In the finisher, successively fed sheets of recording paper are aligned and stopped, and stapled at one or a plurality of positions using one or a plurality of staplers. The finisher includes: a stapler moving mechanism for moving the stapler along the lengthwise direction of a staple binding the sheet of recording paper; a staple position change control mechanism for moving the stapler by a prescribed distance for every set of recording paper to be stapled by using the stapler moving mechanism so that the present staple position is made different from the previous staple position; a recording paper feeding mechanism discharging the sheets of recording paper staple-bound at different positions by the staple position change control mechanism to a discharge tray; and a paper amount setting mechanism lowering top surface of the discharge tray in accordance with the amount of recording paper fed by the recording paper feeding mechanism, so that the top surface of discharge tray is always kept at a constant position.

The finisher binds sets of recording paper with stapler position shifted set by set. Thus, a plurality of sets can be stacked successively with binding positions not overlapped with each other. This realizes better stacking performance of recording paper, and as compared with the prior art, discharging efficiency can be improved.

In a post-processing apparatus capable of punching and stapling, if binding position for stapling is set, it is possible that options for the punching position interfere with the binding position for stapling. By way of example, when holes are punched on a longer side of A4-sized recording paper and the longer side opposite to the punched side or a shorter side is stapled, filing using the punched holes becomes impossible. Noticing such a problem, the user must change the position for staple binding. If it is necessary to first cancel setting for punching other than stapling and then to change setting of staple binding position, the operation could be very complicated.

Japanese Patent Laying-Open No. 2006-154416 ('416 Reference) discloses a controller for an image forming apparatus solving such a problem. The controller controls an image forming apparatus that forms an image on an image recording sheet in accordance with settings. The controller includes: a setting input mechanism allowing an operator to input setting related to image formation in the image forming apparatus; and a setting changing mechanism for changing, in a manner linked with a change of setting of a first setting item by the setting input mechanism, setting of a second setting item different from the first setting. The changed setting of the second setting item as well as the changed setting of the first setting item are applicable to image formation in the image forming apparatus.

If the setting of the first setting item is changed, the setting of the second setting item is changed appropriately by the controller and, therefore, setting can easily be changed.

According to the prior art, when staple binding at two positions is set and punching is set additionally, a bundle of recording paper (a set of recording paper) is bound by staples at two positions and then punched holed are formed. When punching is set, it follows that the bundle of recording paper on which images are formed is filed, for example, in a 2-hole or 4-hole file-binder. Therefore, the simultaneously set stapling may not be permanently necessary. In other words, stapling may be just a temporary or a makeshift means to prevent the bundle of recording paper from going apart before filing.

According to '416 Reference described above, the sheets are staple-bound at two positions and thereafter punched. It may be the case that for only a temporary or makeshift binding, stapling is done at two positions, or wasteful stapling takes place. As a result, staples are wasted and the power is wasted by the stapler. Further, stapling at two positions may limit the range of position shifting when the stapling is done with staple positions made different as disclosed in '592 Reference.

SUMMARY OF THE INVENTION

Therefore, it is desirable to provide an image forming apparatus having a post-processing apparatus for stapling and punching that reduces wasteful stapling and thereby effectively uses resources and saves energy.

According to a first aspect, the present invention provides an image forming apparatus, used with a post-processing apparatus performing a punching process and a stapling process allowing setting of position and number of staples. The image forming apparatus includes: a detecting device detecting a request in the post-processing unit based on request information input from a user; and a control device connected to receive an output of the detecting device and to be able to control the post-processing apparatus, controlling the post-processing apparatus such that if the detecting device detects requests for the punching process and the stapling process on the same recording paper, manner of staple-binding of the recording paper is set to tentative binding.

Preferably, the manner of tentative binding is stapling at one position.

In the image forming apparatus, when punching and stapling are requested, the process for stapling a bundle of recording paper is set to a tentative mode in which the bundle is stapled at one position as temporary or makeshift binding, rather than firm, two-point stapling. When punching and stapling are set, it follows that stapling is only a temporary or makeshift binding to prevent the bundle of paper on which images are formed from going apart before filing. Therefore, the bundle is stapled only at one point in the tentative manner. As a result, wasteful stapling can be reduced, realizing effective use of resources and energy saving.

More preferably, the control device controls the post-processing apparatus such that if a request for the stapling process using a plurality of staples is detected and thereafter a request for the punching process is detected, manner of binding using a plurality of staples is changed to a manner of binding using one staple.

In the image forming apparatus, when two-point stapling (or stapling at two or more positions) is set and thereafter punching is set, the set two-point stapling is cancelled and changed to staple binding at only one position. As a result, when stapling and punching are both done, wasteful stapling can be reduced from the viewpoint that stapling is only tentative, realizing effective use of resources and energy saving.

After a request for the punching process is detected by the detecting device, the control device may inhibit the stapling process using a plurality of staples by the post-processing apparatus.

In the image forming apparatus, if punching is set before setting stapling, setting of two-point stapling becomes impossible (stapling at two or more positions cannot be set). As a result, when stapling and punching are both done, wasteful stapling can be reduced from the viewpoint that stapling is only tentative, realizing effective use of resources and energy saving.

More preferably, the image forming apparatus further includes a staple position moving mechanism, connected to the detecting device, controlling the post-processing apparatus such that if image is formed on two or more sets of copies, position of stapling is changed set by set.

When images are formed on two or more sets of paper, stapling is done with the stapling position changed set by set. Therefore, even when sets of recording paper are stacked on the discharge tray, staples are not overlapped. The staples are not caught with each other. Therefore, the number of stacks that can be placed on the discharge tray will not be reduced. Discharge failure and irregular stacking can also be prevented.

The image forming apparatus may further include the post-processing apparatus connected to the control device.

In the image forming apparatus in accordance with the present invention, when punching and stapling are requested, not the two-point stapling but stapling at only one position is set for the bundle of recording paper. As a result, when stapling and punching are both done, wasteful stapling can be reduced from the viewpoint that stapling is only tentative, realizing effective use of resources and energy saving.

According to a second aspect, the present invention provides, in an image forming apparatus, used with a post-processing apparatus performing a punching process and a stapling process allowing setting of position and number of staples, a method of controlling the post-processing apparatus. The method includes the steps of: detecting a request for a process in the post-processing apparatus, based on request information input by a user; and controlling the post-processing apparatus such that if the detecting device detects requests for the punching process and the stapling process on the same recording paper, manner of staple-binding of the recording paper is set to tentative binding.

According to a third aspect, the present invention provides, in a computer-controlled image forming apparatus used with a post-processing apparatus performing a punching process and a stapling process allowing setting of position and number of staples, a program product for controlling the post-processing apparatus. The program product includes a computer readable recording medium. The recording medium has recorded thereon a computer program causing, when executed by a computer, said computer to execute a method including the steps of; detecting a request for a process in the post-processing apparatus, based on request information input by a user; and controlling the post-processing apparatus such that if the detecting device detects requests for the punching process and the stapling process on the same recording paper, manner of staple-binding of the recording paper is set to tentative binding.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
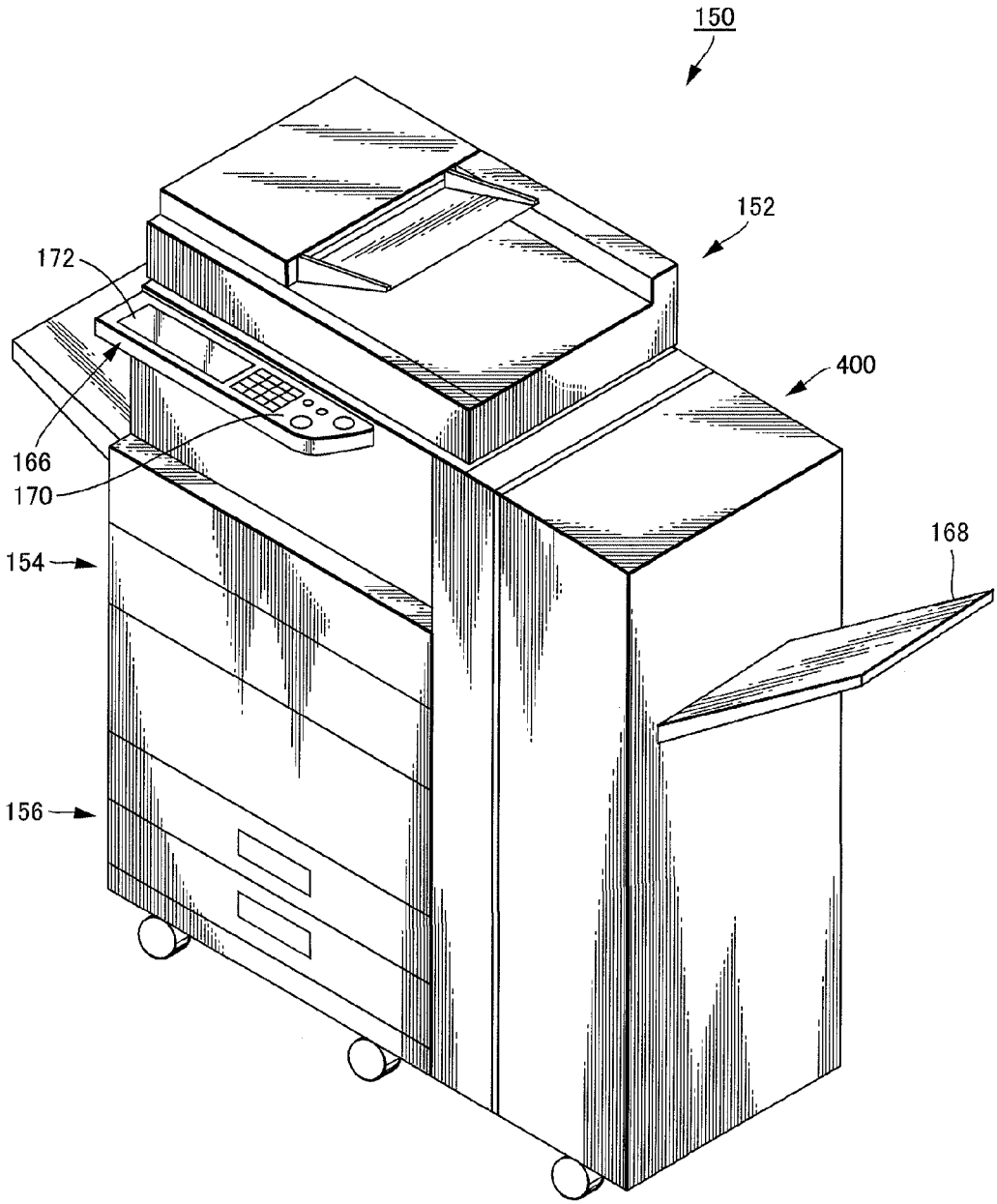
FIG. 1 is a perspective view showing an appearance of the image forming apparatus in accordance with a first embodiment of the present invention.

In the embodiments below, the same components are denoted by the same reference characters. Their functions and names are also the same. Therefore, detailed description thereof will not be repeated. Though an image forming apparatus of electro-photographic system having a post-processing apparatus will be described in the following, the present invention is not limited thereto, and the invention is applicable to any image forming apparatus capable of stapling and punching processes.

First Embodiment

In the following, the image forming apparatus (multifunction peripheral) in accordance with an embodiment will be described. The image forming apparatus has, as described above, a configuration allowing stapling and punching processes.

[Image Forming Apparatus: Function]

Figure 2:
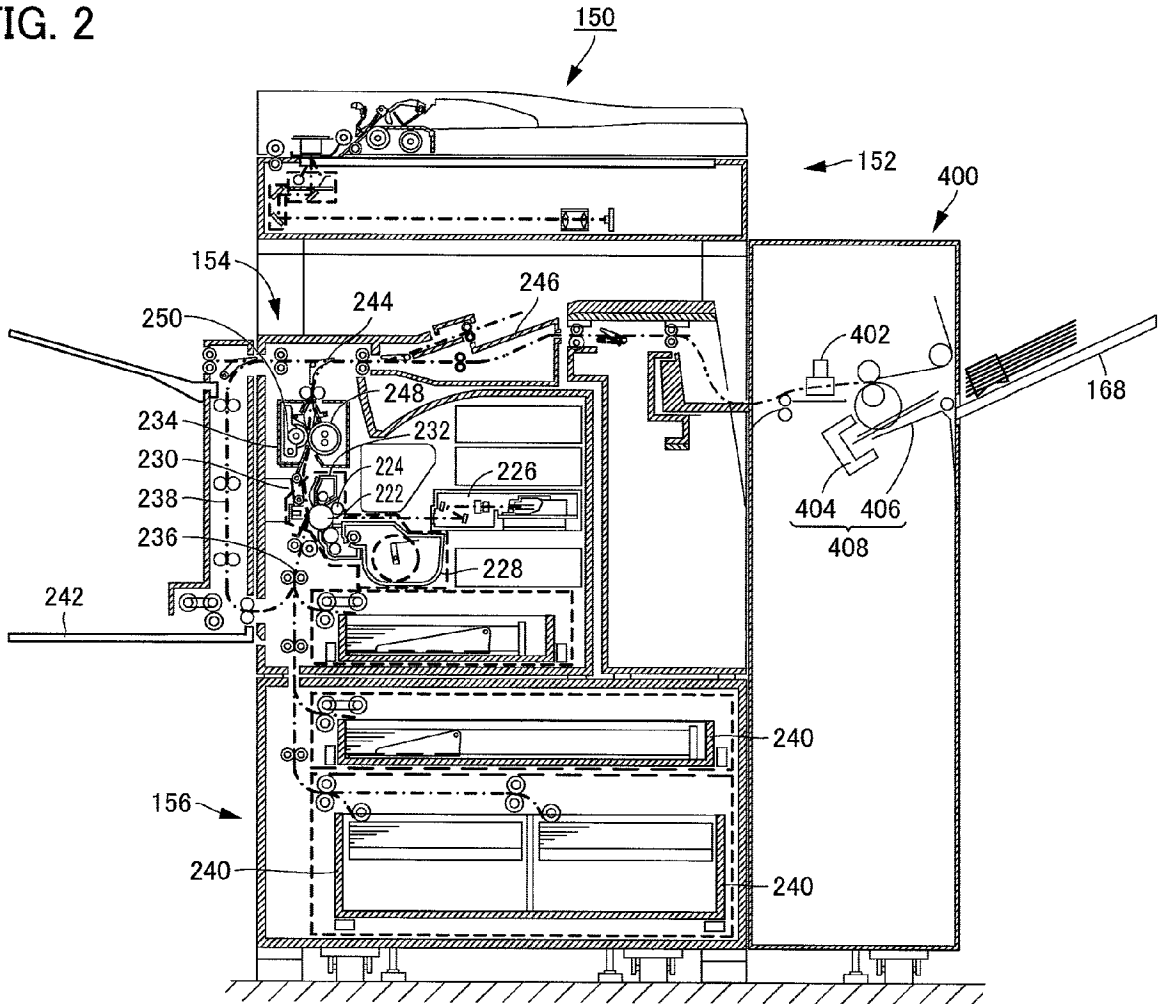
FIG. 2 schematically shows an internal configuration of the image forming apparatus shown in FIG. 1.

Referring to FIGS. 1 and 2, an image forming apparatus 150 includes a document reading unit 152, an image forming unit 154, a paper feed unit 156, and a post-processing unit 400.

In the following, an operation in the copy mode will be described. In the copy mode, mainly document reading unit (also referred to as a scanner unit) 152 and image forming unit 154 operate to realize the copy function.

Figure 4:
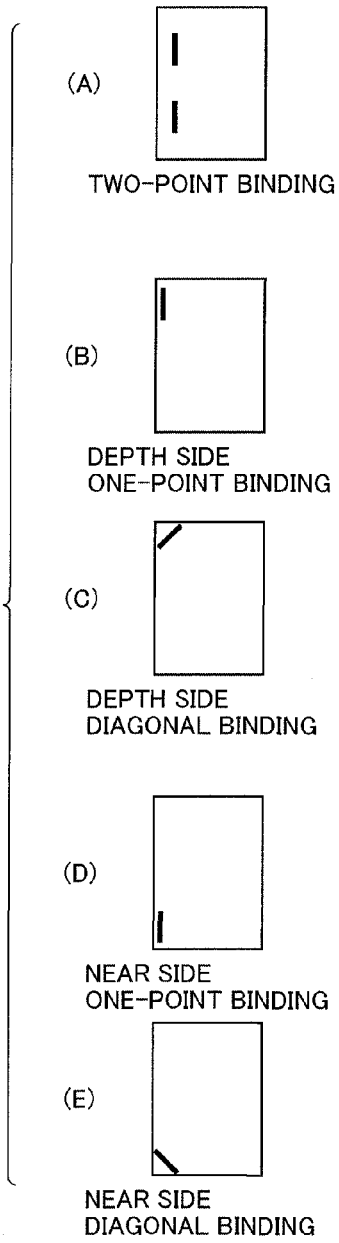
FIG. 4 is a top view of a sheet of recording paper stapled by the image forming apparatus shown in FIG. 1.

In image forming apparatus 150, a document placed on a platen is read by document reading unit 152 as image data, the read image data is input to CPU 300 implemented, for example, by a microcomputer shown in FIG. 4, the image data is subjected to various image processing operations here, and the resulting image data is output to image forming unit 154.

Image forming unit 154 is for printing an image of the document represented by the image data on a recording medium (in most cases, on a sheet of recording paper), and it includes, by way of example, a photoreceptor drum 222, a charger 224, a laser scanning unit (hereinafter also denoted as LSU) 226, a developer 228, a transfer device 230, a cleaning device 232, a fixing device 234 and a neutralizer, not shown.

In image forming unit 154, a main feeding path 236 and a reverse feeding path 238 are provided, and a sheet of recording paper fed from paper feed unit 156 is fed along main feeding path 236. Paper feed unit 156 draws out sheets of recording paper stacked on a paper feed cassette 240 or on a manual feed tray 242 one by one, and feeds the sheet of paper to main feeding path 236 of image forming unit 154.

While the sheet of recording paper is fed along main feeding path 236 of image forming unit 154, the sheet passes between photoreceptor drum 222 and transfer device 230, and further passes through fixing device 234, whereby printing is done on the sheet of recording paper.

Photoreceptor drum 222 rotates in one direction, and its surface is cleaned by cleaning device 232 and the neutralizer and, thereafter, uniformly charged by charger 224.

LSU 226 modulates the laser beam based on the image data to be printed, and repeatedly scans the surface of photoreceptor drum 222 with the laser beam in a main scanning direction, whereby an electrostatic latent image is formed on the surface of photoreceptor drum 222.

Developer 228 develops the electrostatic latent image by supplying toner to the surface of photoreceptor drum 222, and thus, a toner image is formed on the surface of photoreceptor drum 222.

Transfer device 230 transfers the toner image on the surface of photoreceptor drum 222 to the sheet of recording paper passing between transfer device 230 and the photoreceptor drum 222.

Fixing device 234 includes a heating roller 248 for heating the sheet of recording paper and a pressure roller 250 for pressing the sheet of recording paper. As the sheet of recording paper is heated by heating roller 248 and pressed by pressure roller 250, the toner image that has been transferred to the sheet of recording paper is fixed on the sheet. A heater is heated by electric power supplied to fixing device 234 and controlled such that temperature of heating roller 248 attains to an appropriate temperature for fixing.

At a position of connection between main feeding path and reverse feeding path 238, a separation pawl 244 is arranged. When printing is done only on one side of the sheet of recording paper, separation pawl 244 is so positioned that the sheet of recording paper fed from fixing device 234 is guided to paper discharge tray 246 or through post-processing unit 400 to discharge tray 168.

When printing is done on both sides of the sheet of recording paper, separation pawl 244 is turned to a prescribed direction, so that the sheet of recording paper is guided to reverse feeding path 238. The sheet of recording paper passes through reverse feeding path 238, turned upside-down and again fed to main feeding path 236, and while it is again fed along main feeding path, printing is done on its rear surface, and thereafter the sheet is guided to paper discharge tray 246 or to paper discharge tray 168.

The sheet of recording paper printed in the above-described manner is guided to paper discharge tray 246 or through post-processing unit 400 to paper discharge tray 168. In post-processing unit 400, the punching process of punching holes in the recording paper on which images are formed and stapling process of staple-binding bundle of recording paper using a stapler are performed. In post-processing unit 400, each sheet of recording paper is punched, or a bundle of recording paper is stapled, whereby a finished printout is formed.

As shown in FIG. 2, post-processing unit 400 includes a punching unit 402 for punching a hole on a rear-end side along the feeding direction of each sheet of recording paper, and a stapling unit 408 with a stapler 404 and a staple tray 406. The recording paper fed to post-processing unit 400 has a prescribed number of holes punched at prescribed positions by punching unit 402 as needed, and the recording paper fed to post-processing unit 400 is bound as a bundle of recording paper by a prescribed number of staples at prescribed positions, by stapling unit 408.

Punching unit 402 includes a punching shaft driven to rotate in accordance with an instruction from CPU 300, a punch coupled to punching shaft with an eccentric cum interposed, and dies on which inner wall the punch slides. The dies are arranged opposite to each other facing the front and rear sides of the recording paper, respectively. Specifically, the dies are arranged such that when the sheet of recording paper is fed to the punching unit 402, the recording paper is pinched between opposing two dies.

The punching unit 402 is structured such that when the punching shaft 90 is rotated by 90 degrees in this state, by the action of eccentric cam, the punch moves along the inner walls of front side and rear side dies to punch a hole in the recording paper. Further, punching unit 402 is structured such that when the punching shaft is further rotated by 90 degrees, the punch returns to the original position. With such a structure, punching unit 402 punches a hole in a first sheet of recording paper by rotating the punching shaft by 180 degrees in one direction, and punches a hole in a second sheet of recording paper by rotating the punching shaft by 180 degrees in the opposite direction.

The structure of punching unit 402 is not limited to the above. Any structure that can punch a hole in a sheet or a bundle of recording paper may be used. The number of punched holes may be any number not smaller than two. It is common to punch two to four holes.

The recording paper fed to stapling unit 408 is placed on staple tray 406 and if the unit number of sheets of recording paper to be bound is stacked on staple tray 406, the bundle of recording paper is bound by a prescribed number of staples at a prescribed position or positions, and then the bundle is discharged to discharge tray 168. The position of stapling carried out by stapler 404 and the movement of stapler 404 will be described later.

[Image Forming Apparatus: Hardware Configuration]

Figure 3:
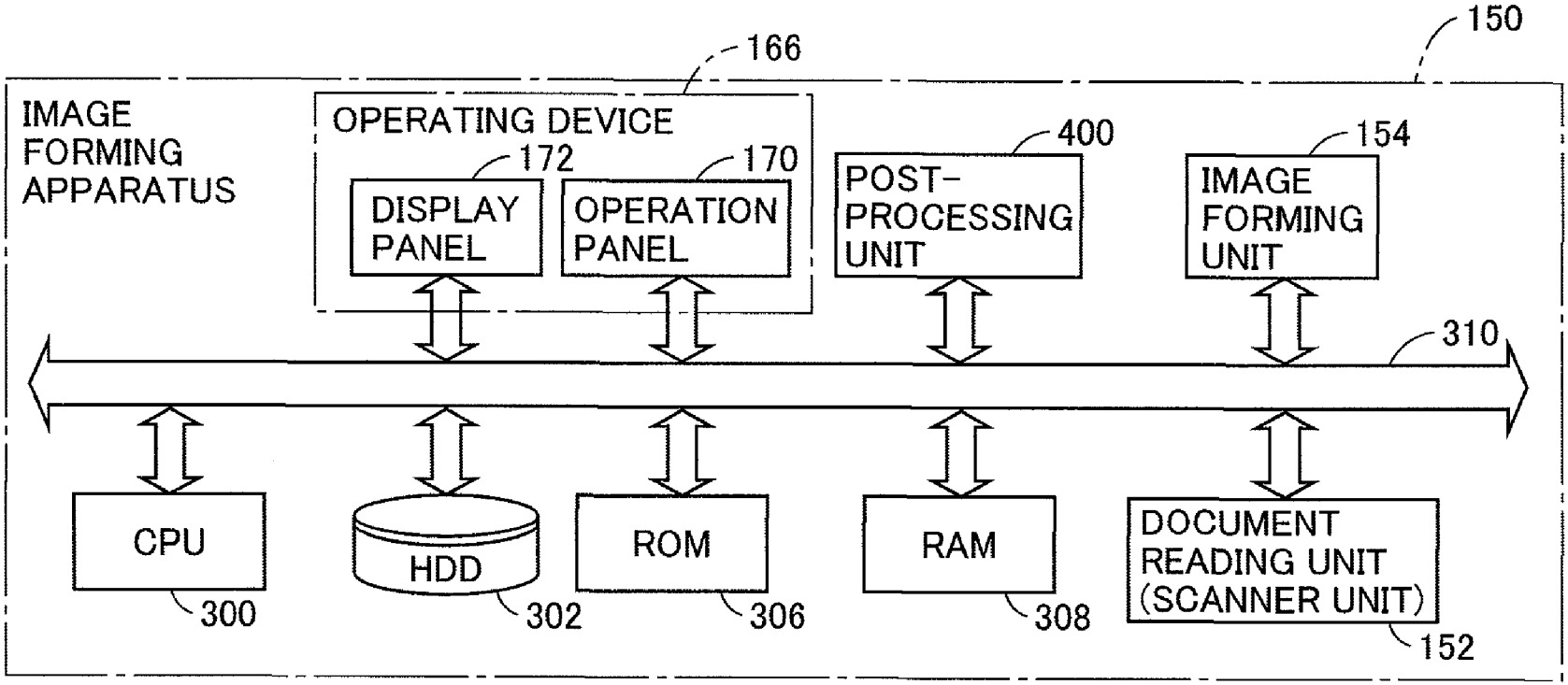
FIG. 3 is a functional block diagram showing hardware configuration of the image forming apparatus shown in FIG. 1.

Referring to FIG. 3, image forming apparatus 150 further includes: an operating device 166 allowing setting related to the copy function; an HDD (Hard Disk Drive) 302 as a non-volatile storage area capable of storing programs and data even when power is cut off; an ROM (Read Only Memory) 306 for storing programs and the like; and an RAM (Random Access Memory) 308 for providing a storage area when a program is executed.

Image forming apparatus 150 further includes a bus 310 connected to document reading unit 152, image forming unit 154, post-processing unit 400, operating device 166, ROM 306, HDD 302 and RAM 308, and a CPU 300 connected to bus 310, for realizing general functions as the image forming apparatus.

ROM 306 stores programs and data necessary for controlling operations of image forming apparatus 150. CPU 300 controls image forming apparatus 150 in accordance with the programs and data stored in ROM 306, and executes control related to various functions of image forming apparatus 150.

RAM 308 provides a function of a working memory for temporarily storing results of operations and processes by CPU 300, and a function of a frame memory for storing image data.

Document reading unit 152, image forming unit 154, a flat, plate-shaped operation panel 170 and display panel 172 of operating device 166, ROM 306, HDD 302 and RAM 308 are controlled by CPU 300 executing a prescribed program.

Operating device 166 includes: a plate-shaped operation panel 170 arranged on the right side on a surface of operating device 166, provided with hardware keys including ten keys and various other operation buttons (for example, a start button); and a display panel 172 formed of a small, touch-panel liquid crystal display device, arranged on the central to the left side of operating device 166. Operation panel 170 and display panel 172 are held in one housing, and operating device 166 is formed integrally to be one piece.

In operating device 166, state of image forming apparatus 150, and status of job processing are displayed on display panel 172. On a display area of liquid crystal display of display panel 172, selection buttons are displayed. When a portion where the selection button is displayed is pressed, the pressed position is detected by the touch panel. By comparing the display position of the selection button and the position where the touch panel is pressed using a program, setting of a function and instruction of an operation of image forming apparatus 150 becomes possible. Such selection buttons are buttons displayed on display panel 172 by software.

When a user presses a button displayed on display panel 172, the program detects that a request corresponding to the pressed button is made, and the process corresponding to the request is executed. The touch panel, a display program for displaying buttons and the like on the touch panel, and a program detecting a user operation on the touch panel and interpreting the corresponding request operate together as a detecting device detecting the user's request.

[Image Forming Apparatus: Stapling Function]

In FIG. 4, the left side of the figure corresponds to the rear end of the feeding direction, and the bundle of recording paper is staple-bound on the rear end side.

FIG. 4(A) shows staple positions of two-point binding, 4(B) shows a staple position of depth side one-point binding, 4(C) shows a staple position of depth side diagonal binding, 4(D) shows a staple position of near side one-point binding, and 4(E) shows a staple position of near side diagonal binding.

In image forming apparatus 150 in accordance with the present embodiment, when punching and stapling processes are both performed, the post-processing is set such that two-point binding of the bundle of recording paper shown in FIG. 4(A) cannot be set, and when a plurality of sets are to be copied, the post-processing is set such that one-point stapling as shown in FIGS. 4(B) and 4(D) is done with stapling position changed set by set.

In order to bind the bundle of recording paper at prescribed positions using a prescribed number of staples as shown in FIG. 4, stapler 404 is provided with a moving mechanism. The moving operation of stapler 404 will be described with reference to FIGS. 5 to 8.

Stapler 404 is moved by a stapler moving motor. The home position is detected by a stapler movement home position sensor. In response to an operation start instruction from CPU 300, stapler 404 moves to the center of a moving range. The movement takes place regardless of the type of paper discharge, because the type of paper discharge is not yet determined at this time point. If there is a staple instruction issued from CPU 300 by the time when the first sheet reaches post-processing unit 400, stapler 404 moves to a staple standby position corresponding to the staple position and the size of recording paper.

The standby positions of stapler 404 and staple positions (positions of stapling) in accordance with the staple mode (position and number) are shown in FIGS. 5 to 8. In FIGS. 5 to 8, arrows represent the feeding direction of recording paper in staple tray 406 (the direction of drawing to staple tray 406). Further, as shown in FIGS. 5 to 8, stoppers 410 and 412 and a guide plate 420 are provided to place the recording paper on a prescribed position of staple tray 406. The front and rear sides of recording paper in FIGS. 4 to 8 are determined on the assumption that, in image forming apparatus 150, the sheet is discharged with the front side facing upward. There are image forming apparatuses in which the sheet is discharged with the rear side facing upward. Therefore, the front and rear sides of recording sheet may be reversed to that shown in the figures, or the depth side and the near side of recording paper may be reversed to that shown in the figures.

Figure 5:
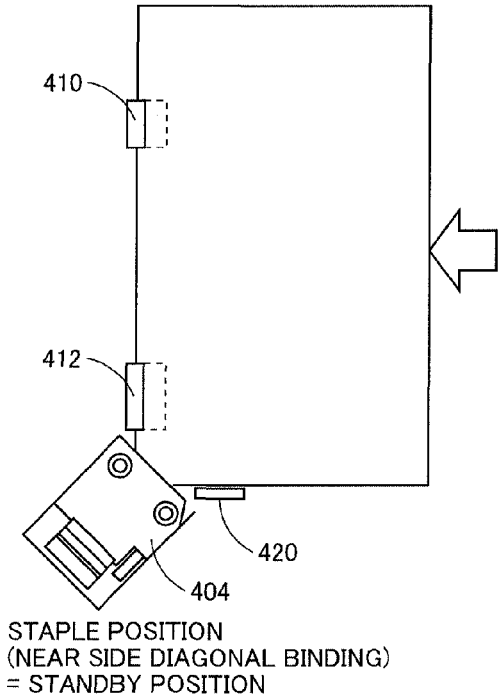
FIGS. 5 to 8 show operations of the stapler in the image forming apparatus shown in FIG. 1.
Figure 6:
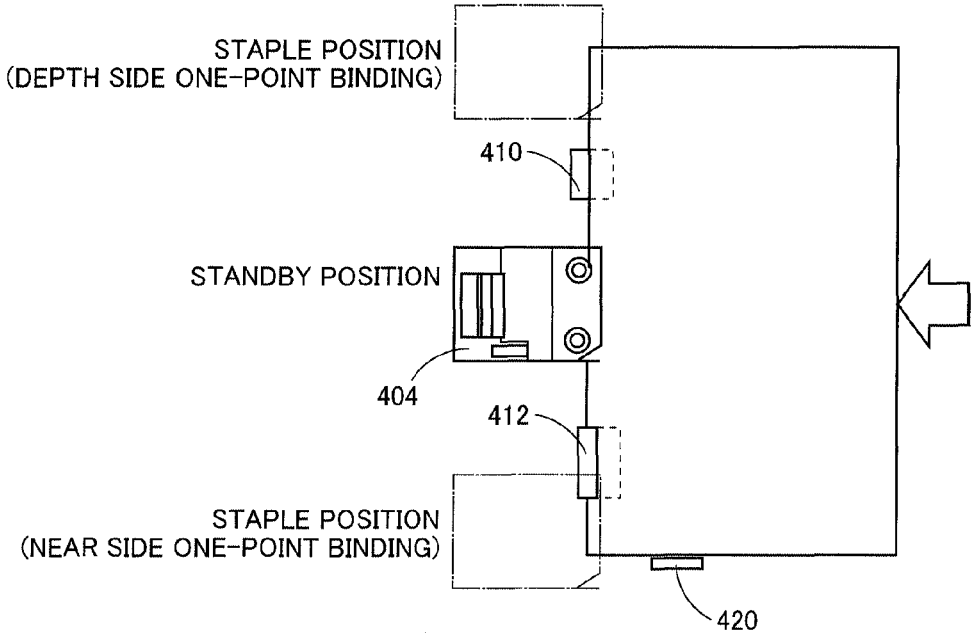
Figure 7:
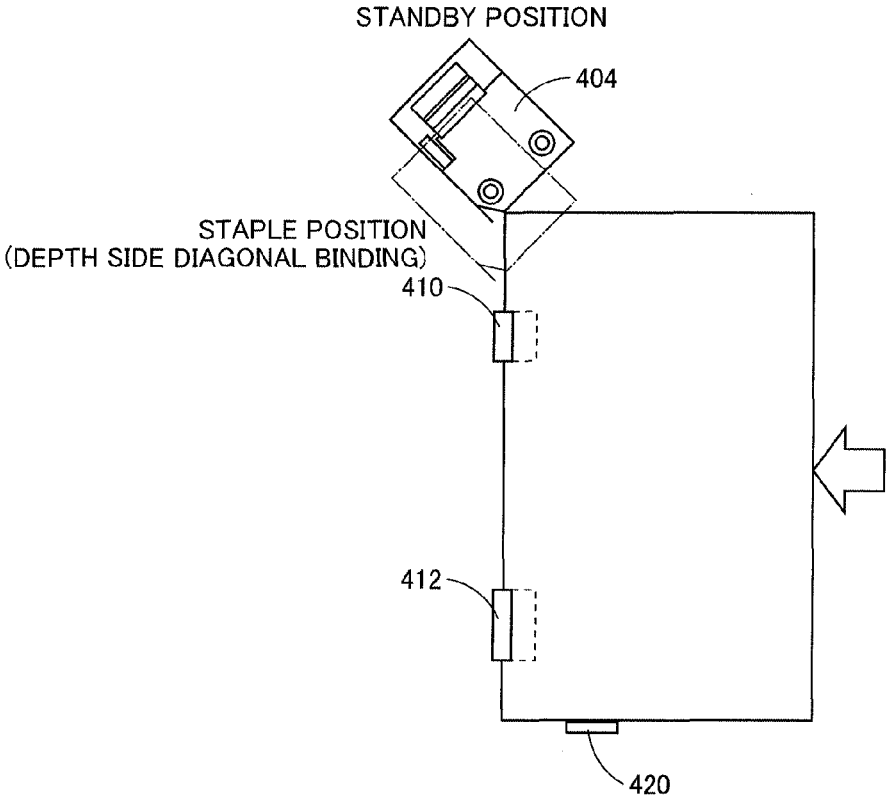
Figure 8:
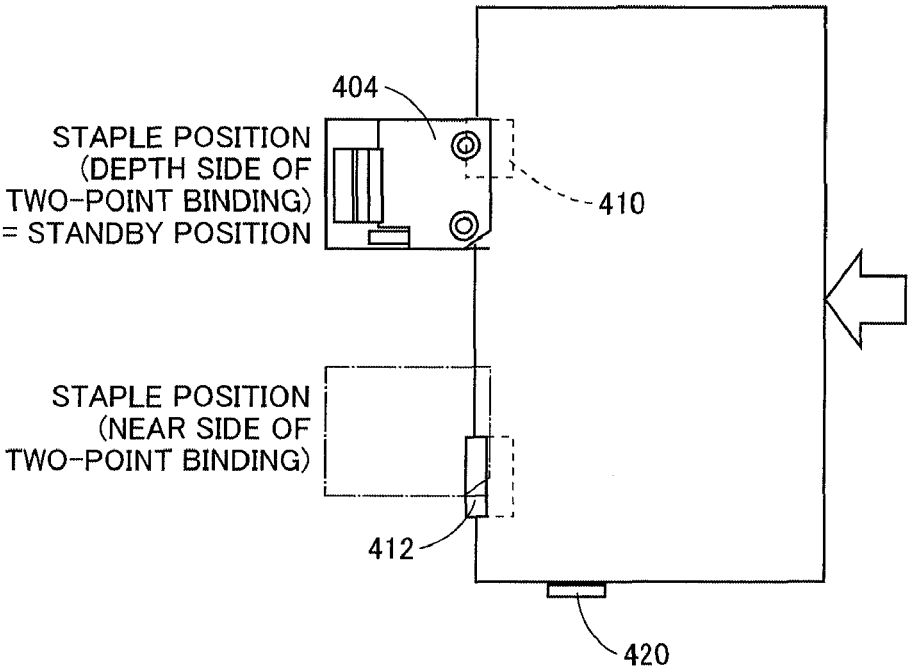

FIG. 5 corresponds to the near side diagonal binding shown in FIG. 4(E), FIG. 6 corresponds to near side one-point binding of FIG. 4(D) and depth side one-point binding of FIG. 4(B), FIG. 7 corresponds to the depth side diagonal binding of FIG. 4(C), and FIG. 8 corresponds to two-point binding of FIG. 4(A).

As shown in FIG. 5, for near side diagonal binding, stapler 404 waits at the same position as the stapling position. In other words, stapler 404 staples without moving from the standby position.

As shown in FIG. 6, for near side one-point binding and depth side one-point binding, stapler 404 waits at the central position. Here, stapler 404 reciprocates between the standby position and the staple position for each stapling operation. In one-point binding shown in FIG. 6, it is possible to change the staple position for each bundle of recording paper in one copy job. By such an approach, stapling is done with staple positions shifted and, therefore, when discharged to discharge tray 168, staples do not overlap with each other. Recording paper does not rise high at a portion. Thus, the number of copies to be stacked on discharge tray 168 is not reduced, and the work efficiency is not lowered. Further, since the staples are not at the same position, the staple of recording paper being discharged at present is not caught by the staple of recording paper discharged last time. Therefore, discharge failure can be avoided, and irregular stacking can be avoided.

For depth side diagonal binding as shown in FIG. 7, stapler 404 waits at a position deeper than the staple position. At this time, stapler 404 reciprocates between the standby position and the staple position for every staple operation.

For two-point binding as shown in FIG. 8, stapler 404 waits at the staple position on the depth side of recording paper. Here, it is assumed that the order of stapling of two positions is depth side first and near side thereafter. Therefore, after the stapling operation on the depth side, stapler 404 moves to the near side staple position. Specifically, stapler 404 reciprocates between the depth side staple position and the near side staple position for each staple operation.

The structure of stapling unit 408 is not limited to the above. Any structure that can staple a bundle of recording paper may be used. Further, the number of stapling is at least one and not specifically limited. Stapling process using one or two staples for binding a bundle of recording paper is common.

Image forming apparatus 150 executes a program having the software configuration as described below, to control setting process in post-processing unit 400.

[Software Configuration]

Figure 9:
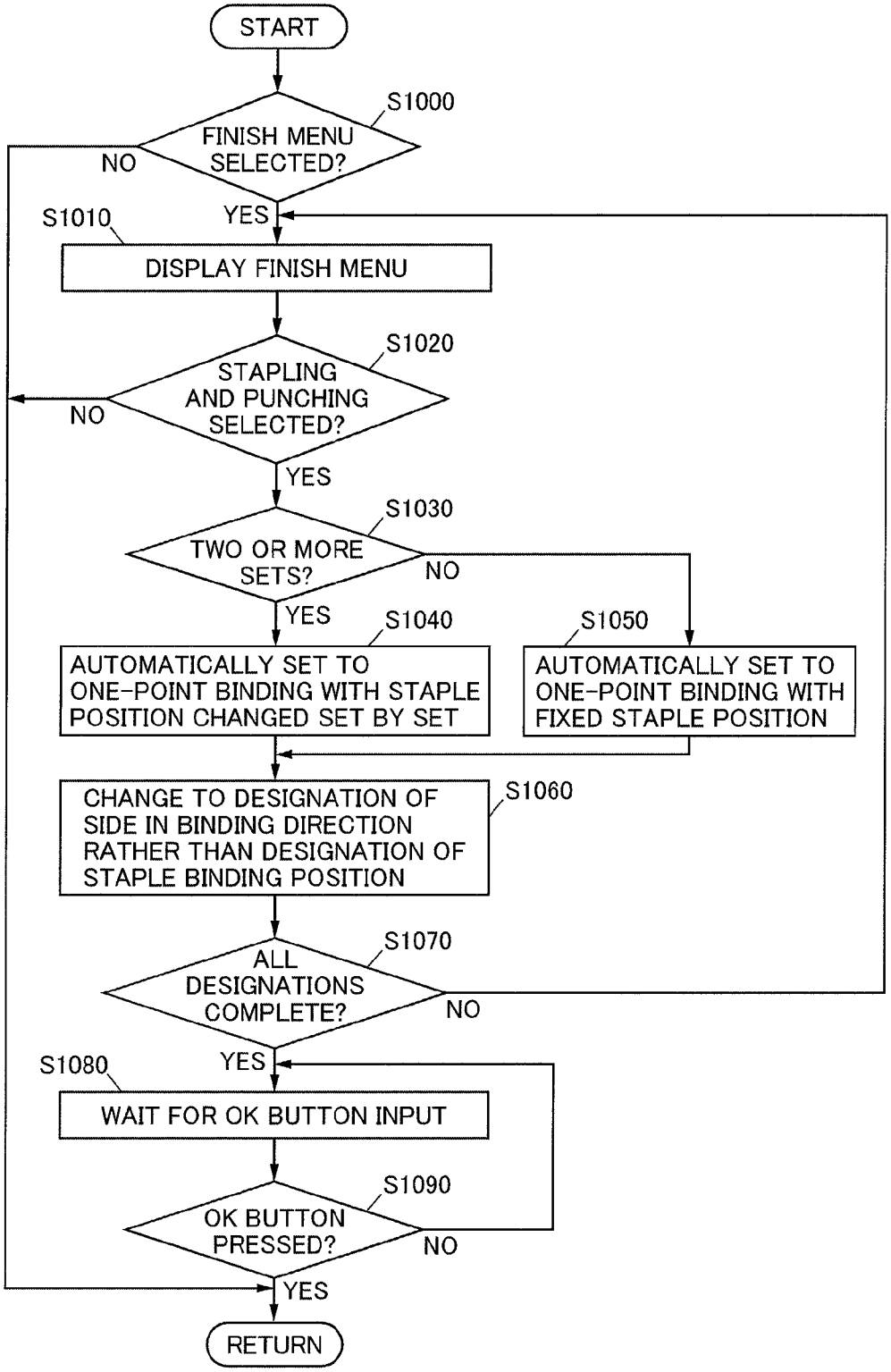
FIG. 9 is a flowchart representing a control structure of a post-processing setting program executed in the image forming apparatus in accordance with the first embodiment of the present invention.

FIG. 9 is a flowchart representing a control structure of a post-processing setting program executed by image forming apparatus 150. The program is described as a sub-routine. Specifically, the program is executed when post-processing setting (finishing setting) is requested. CPU 300 of image forming apparatus 150 executes, in parallel with such a program, a program for realizing general functions of an image forming apparatus. The program, however, is not directly related to the characterizing part of the present invention and, therefore, details thereof will not be described here.

Referring to FIG. 9, at step (hereinafter step will be referred to as S) 1000, CPU 300 of image forming apparatus 150 (hereinafter, simply referred to as CPU 300) determines whether or not a finishing menu (post-processing menu) is selected. At this time, if a finish button (a software button displayed on display panel 172) of a main menu is pressed by the user, CPU 300 determines that the finishing menu is selected. If the finishing menu is selected (YES at S1000), the process proceeds to S1010. Otherwise (NO at S1000), the process ends.

At S1010, CPU 300 displays the finishing menu on display panel 172. At S1020, CPU 300 determines whether or not the stapling process and the punching process are selected. Here, by way of example, if a stapling process button and a punching process button (software buttons displayed on display panel 172) are pressed by the user, CPU 300 determines that the stapling process and the punching process are selected. In the present embodiment, the order of selection of the stapling process and the punching process is not specifically limited. If the stapling process and the punching process are selected (YES at S1020), the process proceeds to S1030. Otherwise (NO at S1020), the process ends.

At S1030, CPU 300 determines whether or not two or more sets of copies are to be made. If two or more sets are to be made (YES at S1030), the process proceeds to S1040. If the number of sets is one (NO at S1030), the process proceeds to S1050.

At S1040, CPU 300 automatically sets the stapling process such that one-point stapling is to be done with the stapling position changed set by set (for every prescribed bundle of recording paper). Thereafter, the process proceeds to S1060. At S1050, CPU 300 automatically sets the stapling process such that one-point stapling is to be done at one fixed position.

At S1060, CPU 300 changes, on the finishing menu, designation of staple binding position to designation of a side in the binding direction. The process of S1060 may be automatically done with the direction of filing determined automatically based on the size and direction of document as well as the size of recording paper.

At S1070, CPU 300 determines whether or not all designations related to finishing have been complete. If all designations related to finishing are completed (YES at S1070), the process proceeds to S1080. Otherwise (NO at S1070), the process returns to S1010. If all designations related to finishing are not completed after a prescribed time period, the finishing setting process may be stopped and the process may be terminated.

At S1080, CPU 300 waits for an input of OK button. At S1090, CPU 300 determines whether or not the OK button is pressed. Here, by way of example, if the OK button of finishing menu (software button displayed on display panel 172) is pressed, CPU 300 determines that the OK button is pressed. If the OK button is pressed (YES at S1090), the process ends. Otherwise (NO at S1090), the process returns to S1080, and waits until the OK button is pressed. If the OK button is not pressed, after a prescribed time period, the finishing setting process may be stopped and the process may be terminated.

[Finishing Process Setting Operation]

Figure 10:
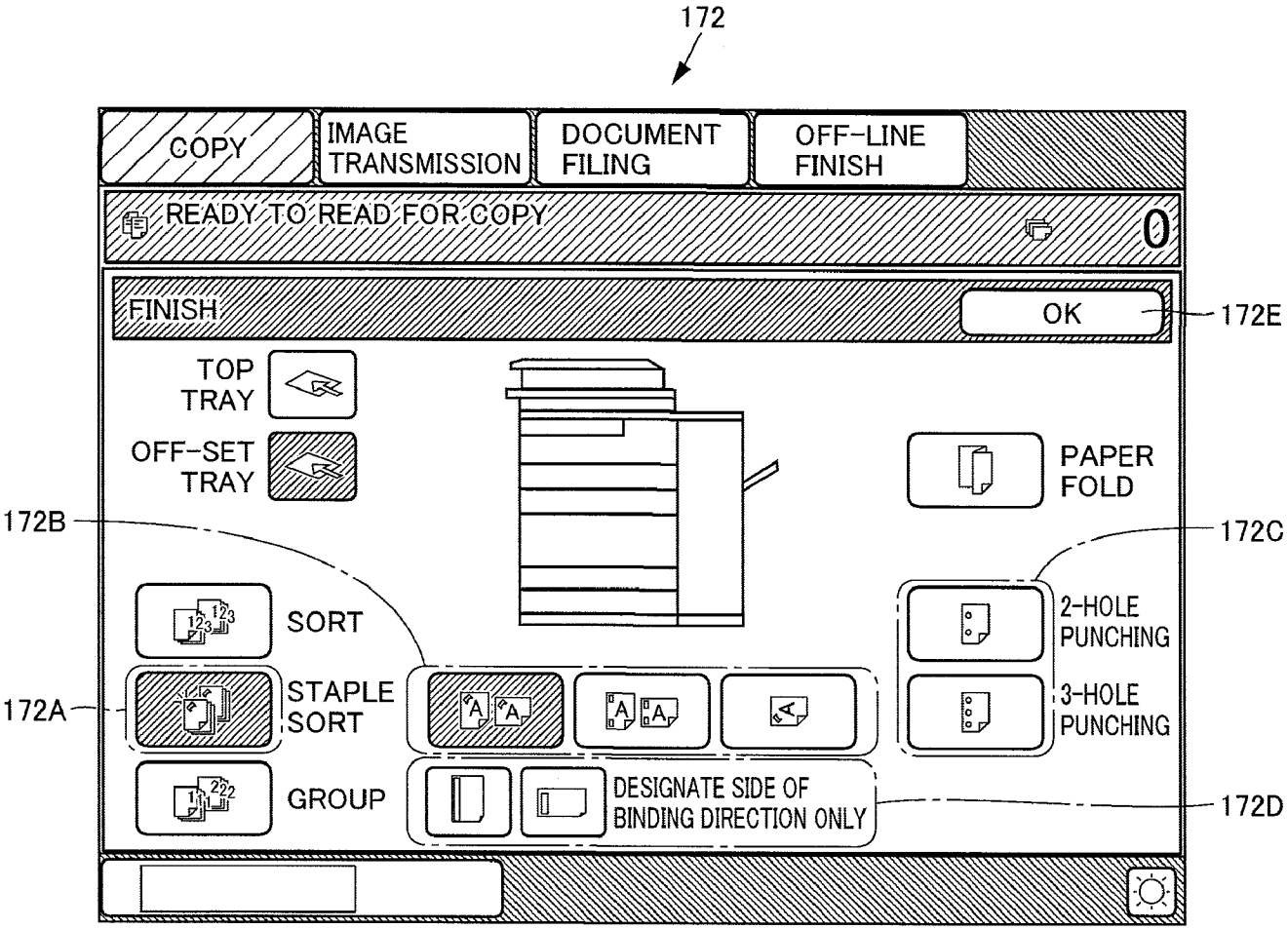
FIG. 10 shows an exemplary image displayed on a display panel of the image forming apparatus in accordance with the first embodiment of the present invention.

The operation of image forming apparatus 150 in accordance with the present embodiment based on the structure and flowchart as above will be described with reference to FIG. 10 showing an example of a finishing menu image.

When the user presses the finish button displayed on the main menu of the copy mode (YES at S1000), the finish menu image shown in FIG. 10 is displayed on display panel 172 (S1010).

When the stapling process button 172A and the punching process button 172C are pressed (YES at S1020), whether two or more sets of copies are to be made is determined (S1030). If the number of sets to be copied is set to two or larger on the main menu of copy mode, the number of sets is two or more (YES at S1030), and hence, stapling process is automatically set such that one-point binding is done with the stapling position changed set by set (or every prescribed bundle of recording paper) (S1040). If the number of sets is set to one on the main menu of copy mode, the number of sets is not two or more (NO at S1030), and the stapling process is automatically set such that one-point binding is done at a fixed position.

In this manner, if the stapling process and the punching process are selected, the finishing process menu is changed so that not the staple binding position but the side in the binding direction is designated (S1060). At this time, the staple position designating button 172B of FIG. 10 is invalidated, and a button 172D designating a side in the binding direction is validated.

When the user completes all designations including the designation of a side in the binding direction (YES at S1070), an input of OK button is received (S1080). When the user presses OK button 172E (YES at S1090), setting for the finishing process is complete, and the control returns to the main menu of the copy mode.

In image forming apparatus 150 set in this manner, when the start button is pressed, a copy operation starts. If the stapling and punching processes are selected and one set of copies is to be made, each sheet of recording paper is punched and (1) stapling process is done at the staple position shown in FIG. 5 and near side diagonal stapling is done at one position as shown in FIG. 4(E), (2) stapling process is done at the staple position shown in FIG. 6 and near side one-point stapling is done as shown in FIG. 4(D) or depth side one-point stapling is done as shown in FIG. 4(B), or (3) stapling process is done at the staple position shown in FIG. 7 and depth side diagonal stapling is done at one position as shown in FIG. 4(C).

If the stapling and punching processes are selected and two or more sets of copies are to be made, (4) stapling process is done with stapling position shifted bundle by bundle of recording paper. Here, stapling process is done only at one point between the near side staple position shown in FIG. 4(D) and the depth side staple position shown in FIG. 4(B).

As described above, in the image forming apparatus in accordance with the present embodiment, if the punching and stapling processes are requested, not the two-point stapling but only one-point stapling is set for the bundle of recording paper. If a plurality of sets are to be copied, one-point binding with the staple position shifted set by set is set. As a result, when stapling and punching are both done, wasteful stapling can be reduced from the viewpoint that stapling is only tentative, realizing effective use of resources and energy saving. Further, if a plurality of sets are to be copied, the stapling process is done with staple positions shifted. Therefore, staples are not overlapped. Thus, the number of copies to be stacked on discharge tray 168 is not reduced. Further, since the staples are not caught with each other, discharge failure can be avoided, and irregular stacking can be avoided.

Second Embodiment

In the following, the image forming apparatus in accordance with a second embodiment of the present invention will be described. Image forming apparatus 150 and post-processing unit 400 (FIGS. 1 to 8) are the same as those of the first embodiment and, therefore, detailed description thereof will not be repeated here.

Image forming apparatus 150 in accordance with the present embodiment differs from the first embodiment described above in the control structure of the program executed by CPU 300. Except for this point, reference characters are the same as those of the first embodiment. Structures and functions of the corresponding portions are the same as those of the first embodiment described above.

[Software Configuration]

Figure 11:
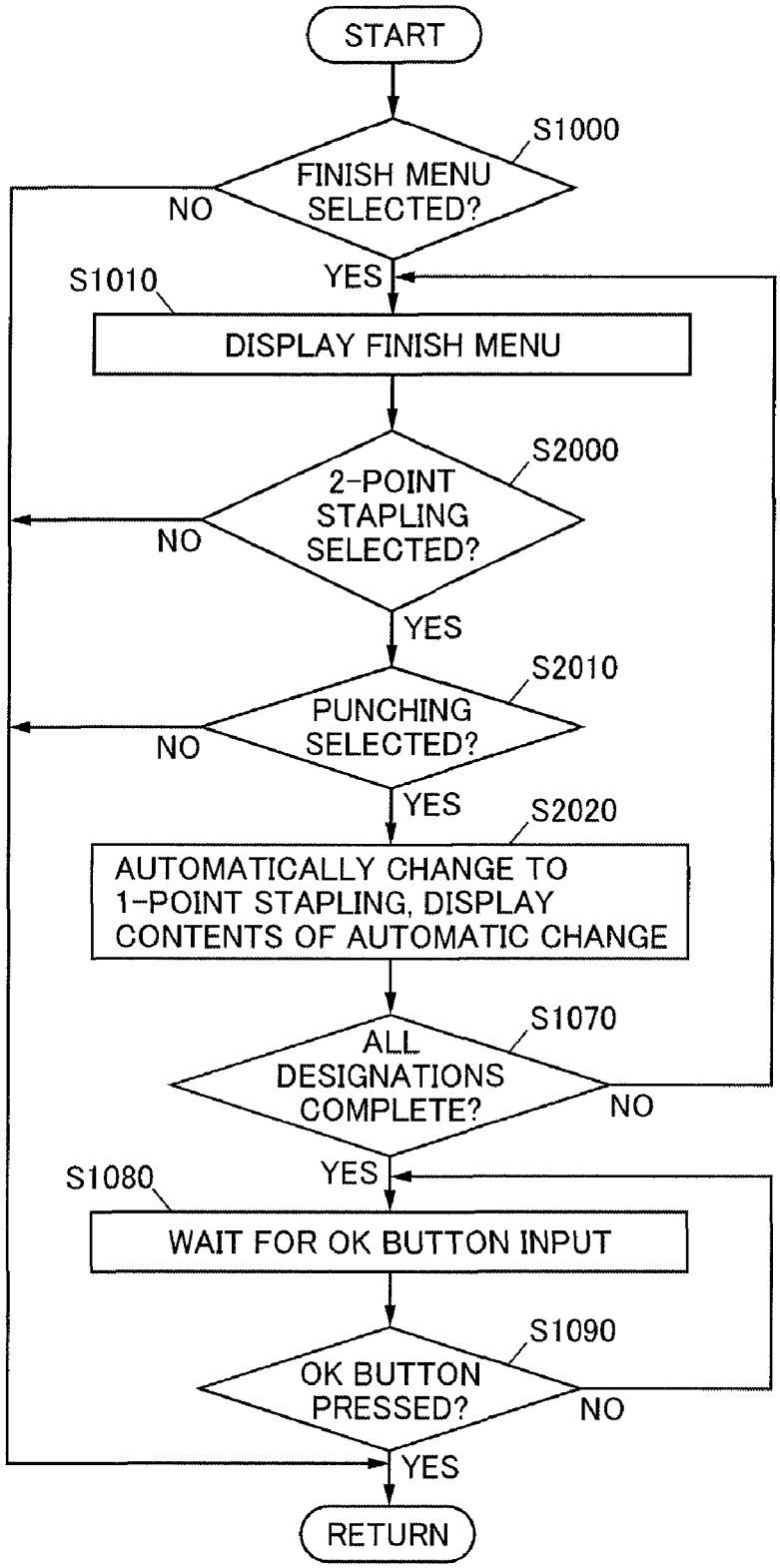
FIG. 11 is a flowchart representing a control structure of a post-processing setting program executed in the image forming apparatus in accordance with a second embodiment of the present invention.

FIG. 11 is a flowchart representing a control structure of a post-processing setting program executed by image forming apparatus 150, corresponding to the flowchart of FIG. 9. CPU 300 of image forming apparatus 150 executes, in parallel with such a program, a program realizing general functions of the image forming apparatus, as in the first embodiment described above. The program, however, is not directly related to the characterizing part of the present invention and, therefore, details thereof will not be described here.

Referring to FIG. 11, at S2000, CPU 300 determines whether or not two-point stapling is selected. Here, by way of example, if the stapling process button and the two-point stapling button (software buttons displayed on display panel 172) of the finishing menu are pressed by the user, CPU 300 determines that the two-point stapling is selected. If the two-point stapling is selected (YES at S2000), the process proceeds to S2010. Otherwise (NO at S2000), the process ends.

At S2010, CPU 300 determines whether or not the punching process is selected. Here, by way of example, if the punching process button of finishing menu is pressed by the user, CPU 300 determines that the punching process is selected. In the present embodiment, it is assumed that the punching process is set after the setting of stapling process. If the punching process is selected (YES at S2010), the process proceeds to S2020. Otherwise (NO at S2010), the process ends.

At S2020, CPU 300 automatically changes the two-point stapling selected at S2000 to the stapling at only one position, and displays the changed contents on display panel 172.

[Finishing Process Setting Operation]

The operation of image forming apparatus 150 in accordance with the present embodiment based on the structure and flowchart as above will be described with reference to FIG. 10 showing an example of the finishing menu image. In the following, description of the same operations as those of the first embodiment will not be repeated.

When the user presses the finish button displayed on the main menu of the copy mode (YES at S1000), the finishing menu image shown in FIG. 10 is displayed on display panel 172 (S1010).

When stapling process button 172A and the two-point binding button of staple position designating buttons 172B are pressed (YES at S2000) and punching process button 172C is further pressed (YES at S2010), the two-point stapling process is automatically changed to the stapling process at only one position (S2020).

At this time, the two-point binding button that has been high-lighted to indicate the selected state among the staple position designating buttons 172B is blacked out and the one-point binding button is high-lighted, and the changed contents are displayed on display panel 172 (S2020). At this time, to promote user awareness, the one-point binding button may be flickered.

As in the first embodiment, if a plurality of sets are to be copied, the staple position may be changed bundle by bundle of recording paper in the present embodiment.

As described above, in the image forming apparatus in accordance with the present embodiment, if the two-point stapling process is set and thereafter the punching process is set, the set two-point stapling process is canceled and stapling at only one position is automatically set, and the change is displayed. As a result, when stapling and punching are both done, wasteful stapling can be reduced from the viewpoint that stapling is only tentative, realizing effective use of resources and energy saving.

Third Embodiment

In the following, the image forming apparatus in accordance with the third embodiment of the present invention will be described. Image forming apparatus 150 and post-processing unit 400 (FIGS. 1 to 8) are the same as those of the first embodiment above and, therefore, detailed description thereof will not be repeated here.

Image forming apparatus 150 in accordance with the present embodiment differs from the first and second embodiments described above in the control structure of the program executed by CPU 300. Except for this point, reference characters are the same as those of the first embodiment. Structures and functions of the corresponding portions are the same as those of the first embodiment described above.

[Software Configuration]

Figure 12:
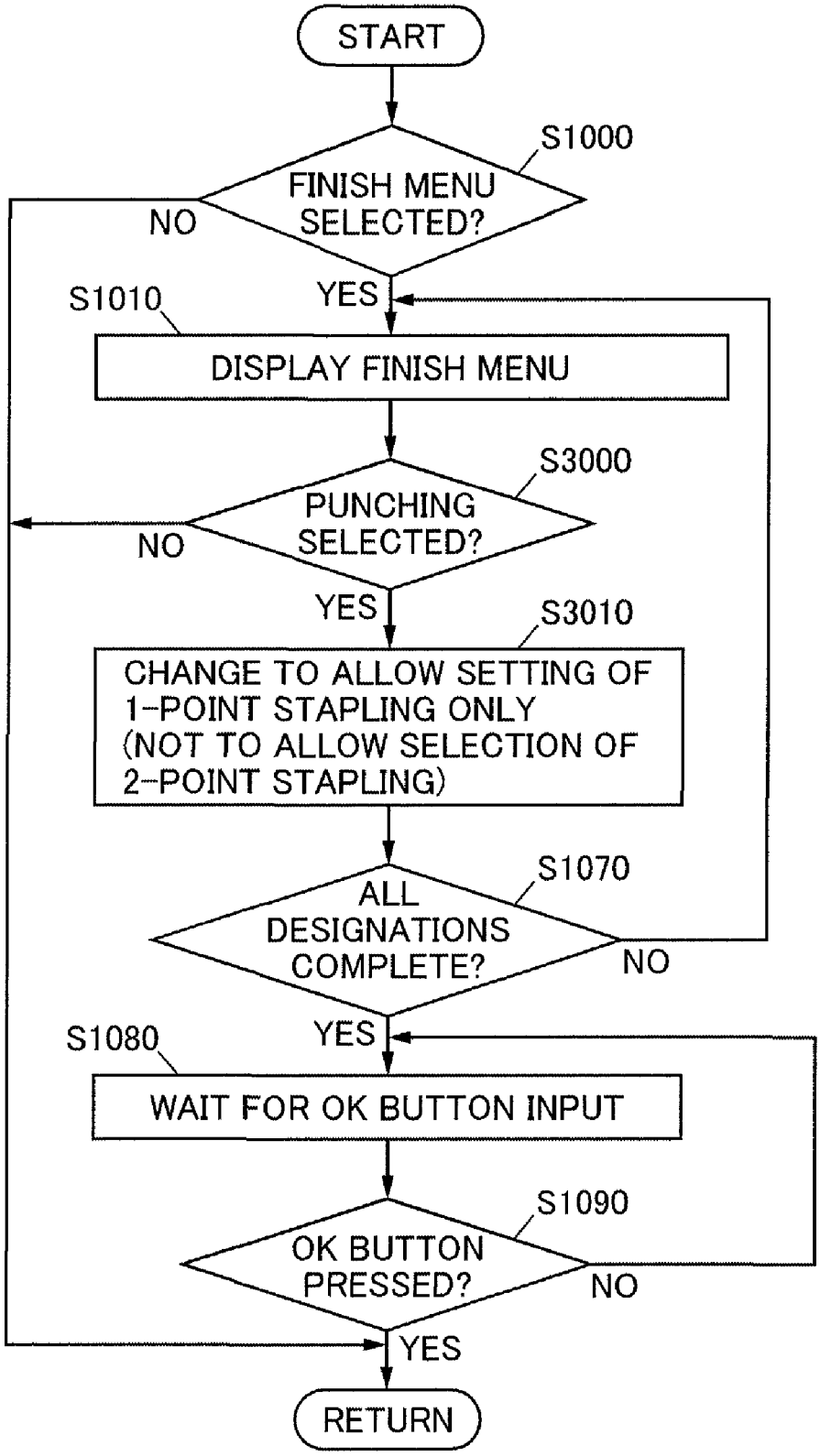
FIG. 12 is a flowchart representing a control structure of a post-processing setting program executed in the image forming apparatus in accordance with a third embodiment of the present invention.

FIG. 12 is a flowchart representing a control structure of a post-processing setting program executed by image forming apparatus 150, corresponding to the flowcharts shown in FIGS. 9 and 11. As in the first embodiment, CPU 300 of image forming apparatus 150 executes, in parallel with such a program, a program for realizing general functions of an image forming apparatus. The program, however, is not directly related to the characterizing part of the present invention and, therefore, details thereof will not be described here.

Referring to FIG. 12, at S3000, CPU 300 determines whether or not the punching process is selected. Here, if the punching process button on the finishing menu is pressed by the user, CPU 300 determines that the punching process is selected. In the present embodiment, it is assumed that the punching process is set before setting the stapling process. If the punching process is selected (YES at S3000), the process proceeds to S3010. Otherwise (NO at S3000), the process ends.

At S3010, CPU 300 changes the finishing menu to allow selection only of the one-point stapling (not to allow two-point stapling).

[Finishing Process Setting Operation]

The operation of image forming apparatus 150 in accordance with the present embodiment based on the structure and flowchart as above will be described with reference to FIG. 10 showing an example of a finishing menu image.

When the user presses the finish button displayed on the main menu of the copy mode (YES at S1000), the finish menu image shown in FIG. 10 is displayed on display panel 172 (S1010).

If punching process button 172C is pressed (YES at S3000), the finishing menu is changed to allow only the one-point stapling (S3010).

In this manner, when the punching process is selected before the stapling process, the finishing menu is changed not to allow selection of the two-point stapling, as regards the positions of stapling (S3010). Here, the two-point stapling button among position designating buttons 172B is invalidated, and the one-point stapling button is validated.

As in the first embodiment, if a plurality of sets are to be copied, the staple position may be changed bundle by bundle of recording paper in the present embodiment.

As described above, in the image forming apparatus in accordance with the present embodiment, if the punching process is set before setting the stapling process, the two-point stapling cannot be set. As a result, when stapling and punching are both done, wasteful stapling can be reduced from the viewpoint that stapling is only tentative, realizing effective use of resources and energy saving.

<Modification>

The manner of tentative staple-binding in the embodiments described above may be modified in the following manner.

Figure 13:
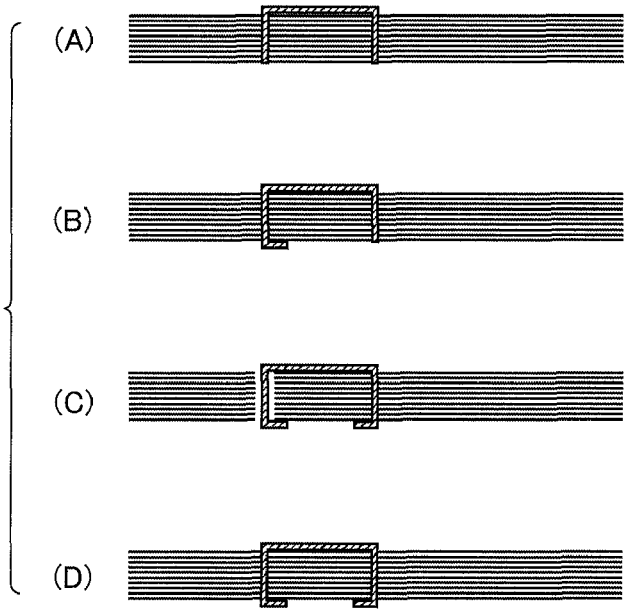
FIG. 13 includes cross-sectional views of the recording paper stapled by the image forming apparatuses in accordance with modifications of the embodiment of the present invention.

(a) In the stapling process, generally, after a staple penetrates through the bundle of recording paper, both ends of the staple are bent on the rear surface side of the paper as shown in FIG. 13(D). The portions to be bent may be cut off, as shown in FIG. 13(A). Then, the staple can be easily removed at the time of filing, while the bundle of recording paper can be prevented from going apart until filing. A mechanism for cutting the staple has been conventionally provided in the post-processing apparatus and, therefore, such an approach does not lead to any increased cost.

(b) The portion to be bent may be cut off only at one side of the staple, as shown in FIG. 13(B).

(c) One side of the staple may be positioned to pass through the punched hole, as shown in FIG. 13(C). Then, the staple can be easily removed at the time of filing, while the bundle of recording paper can be prevented from going apart until filing. A mechanism for moving the stapler has been conventionally provided in the post-processing apparatus as described above and, therefore, such an approach does not lead to any increased cost. These modifications may appropriately be combined.

The embodiments as have been described here are mere examples and should not be interpreted as restrictive. The scope of the present invention is determined by each of the claims with appropriate consideration of the written description of the embodiments and embraces modifications within the meaning of, and equivalent to, the languages in the claims.

What is claimed is:

1. An image forming apparatus, used with a post-processing apparatus performing a punching process and a stapling process allowing setting of position and number of staples, comprising:

a detecting device detecting a request in said post-processing unit based on request information input from a user; and a control device connected to receive an output of said detecting device and to be able to control said post-processing apparatus, controlling said post-processing apparatus such that if said detecting device detects requests for said punching process and said stapling process on the same recording paper, manner of staple-binding of the recording paper is set to tentative binding, wherein said control device controls said post-processing apparatus such that if a request for the stapling process using a plurality of staples is detected and thereafter a request for the punching process is detected, manner of binding using a plurality of staples is changed to a manner of binding using one staple.

2. The image forming apparatus according to claim 1, further comprising a staple position moving mechanism, connected to said detecting device, controlling said post-processing apparatus such that if image is formed on two or more sets of copies, position of stapling is changed set by set.

3. The image forming apparatus according to claim 1, further comprising said post-processing apparatus connected to said control device.

4. In an image forming apparatus, used with a post-processing apparatus performing a punching process and a stapling process allowing setting of position and number of staples, a method of controlling the post-processing apparatus, comprising the steps of:

detecting a request for a process in said post-processing apparatus, based on request information input by a user; and controlling said post-processing apparatus such that if said detecting device detects requests for said punching process and said stapling process on the same recording paper, manner of staple-binding of the recording paper is set to tentative binding, wherein said post-processing apparatus is controlled such that if a request for the stapling process using a plurality of staples is detected and thereafter a request for the punching process is detected, manner of binding using a plurality of staples is changed to a manner of binding using one staple.

5. In a computer-controlled image forming apparatus used with a post-processing apparatus performing a punching process and a stapling process allowing setting of position and number of staples, a program product for controlling the post-processing apparatus, comprising a computer readable recording medium; wherein said recording medium has recorded thereon a computer program causing, when executed by a computer, the computer to execute a method including the steps of:

detecting a request for a process in said post-processing apparatus, based on request information input by a user; and controlling said post-processing apparatus such that if said detecting device detects requests for said punching process and said stapling process on the same recording paper, manner of staple-binding of the recording paper is set to tentative binding, wherein said post-processing apparatus is controlled such that if a request for the stapling process using a plurality of staples is detected and thereafter a request for the punching process is detected, manner of binding using a plurality of staples is changed to a manner of binding using one staple.

* * * * *